US009004941B2

(12) United States Patent
Wang et al.

(10) Patent No.: US 9,004,941 B2
(45) Date of Patent: Apr. 14, 2015

(54) CONNECTOR WITH SIDE POWER BAY

(71) Applicant: Molex Incorporated, Lisle, IL (US)

(72) Inventors: Xi Jia Wang, Singapore (SG); Yih Ping Chua, Singapore (SG)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/973,314

(22) Filed: Aug. 22, 2013

(65) Prior Publication Data

US 2014/0106618 A1 Apr. 17, 2014

(30) Foreign Application Priority Data

Aug. 22, 2012 (TW) ..... 101216154 A

(51) Int. Cl.

| | |
|---|---|
| ***H01R 13/648*** | (2006.01) |
| ***H01R 27/02*** | (2006.01) |
| ***H01R 24/60*** | (2011.01) |
| ***H01R 27/00*** | (2006.01) |

(52) U.S. Cl.

CPC ..... *H01R 27/02* (2013.01); *H01R 24/60* (2013.01); *H01R 27/00* (2013.01)

(58) Field of Classification Search

USPC ..... 439/676, 680, 347, 638, 862, 350, 439/357–358, 631, 632, 607.01, 607.58, 439/639, 78, 660

See application file for complete search history.

(56) References Cited

U.S. PATENT DOCUMENTS

| | | | | |
|---|---|---|---|---|
| 2009/0298351 | A1* | 12/2009 | Xiong et al. | 439/676 |
| 2011/0130014 | A1* | 6/2011 | Zhu et al. | 439/78 |
| 2013/0059479 | A1* | 3/2013 | Ho | 439/639 |

* cited by examiner

*Primary Examiner* — Edwin A. Leon
(74) *Attorney, Agent, or Firm* — Stephen L. Sheldon

(57) ABSTRACT

A receptacle connector, a plug connector and an electrical connector assembly, the receptacle connector comprises a housing, a cage, a separation unit, a plurality of receptacle terminals, and a plurality of receptacle power terminals. The housing comprises a first tongue plate and a second tongue plate which are arranged transversely at an interval. The cage is installed to the housing and surrounds the first tongue plate and the second tongue plate to define a mating space. The separation unit extends into the mating space to separate the mating space into an HDMI receptacle portion and a power receptacle portion which are arranged transversely. The receptacle terminal is provided to the first tongue plate for transmitting a signal conforming to a HDMI transmission specification. The power terminal is provided to the second tongue plate for transmitting power.

18 Claims, 14 Drawing Sheets

CONNECTOR WITH SIDE POWER BAY

RELATED APPLICATIONS

This application claims priority to Taiwanese Application No. 101216154, filed Aug. 22, 2012, which is incorporated herein by reference in its entirety.

FIELD OF THE PRESENT INVENTION

The present application relates to a receptacle connector, a plug connector and an electrical connector assembly, particularly to a receptacle connector, a plug connector and an electrical connector assembly with an additional power supply.

FIELD OF THE PRESENT INVENTION

FIG. 1 and FIG. 2 is an electrical connector assembly in the prior art, the electrical connector assembly comprises a receptacle connector as shown in FIG. 1 and a plug connector fitted for mating the receptacle connector as shown in FIG. 2. The receptacle connector comprises a first housing 11, a plurality of receptacle terminals 121, a plurality of receptacle power terminals 122, and a first cage 13 installed to the housing 11. The first housing 11 has a rectangular first main portion 111 extending transversely, a first protrusion portion 112 protruding upwardly from a top face of the first main portion 111, and a first tongue plate 113 and a second tongue plate 114 respectively extending transversely from the first main portion 111 and the first protrusion portion 112 and arranged at an interval; the plurality of receptacle terminals 121 are provided to the first tongue plate 113, the plurality of receptacle power terminals 122 are provided to the second tongue plate 114.

The plug connector comprises a second housing 14, a plurality of plug terminals 151 and a plurality of plug power terminals 152 provided to the second housing 14, and a second cage 16 is installed to and surrounding the second housing 14. The second housing 14 has a rectangular second main portion 141 extending transversely, and a second protrusion portion 142 protruding upwardly from a top face of the second main portion 141. The second main portion 141 is formed with a third mating cavity 143 at a center thereof; a top face of the second protrusion portion 142 and the second cage 16 together surround to form a fourth mating cavity 144. The plurality of plug terminals 151 protrude from the second housing 14 toward the third mating cavity 143; the plurality of plug power terminals 151 protrude from the second housing 14 toward the fourth mating cavity 144.

When the receptacle connector and the plug connector as described above are mated, the first tongue plate 113 and the second tongue plate 114 of the receptacle connector respectively mate the third mating cavity 143 and the fourth mating cavity 144 of the plug connector, so as to make the receptacle terminal 121 and the receptacle power terminal 122 electrically connect the plug terminal 151 and the plug power terminal 152, respectively, with a design that the receptacle power terminal 122 and the plug power terminal 152 can transmit power, an additional power supply is provided while the electrical connector assembly transmits a signal.

However, although the electrical connector assembly in the prior art is provided with the additional power supply by the receptacle power terminal 122 and the plug power terminal 152, as the second tongue plate 114 for arranging the receptacle power terminal 122 and the first tongue plate 113 are vertically stacked, the electrical connector assembly as described above increases an overall height of the electrical connector assembly, this characteristic, that increases the overall height, makes it difficult to be provided in electronic products today which is gradually for thin-type development. Consequently, the electrical connector assembly in the prior art do have a room for improvement.

SUMMARY OF THE PRESENT INVENTION

Therefore, according to an embodiment, the electrical connector assembly comprises a receptacle connector, a plug connector which can be selectively inserted into the receptacle connector, and an HDMI plug which can be selectively inserted into the receptacle connector.

The receptacle connector comprises a housing, a cage installed to the housing, a separation unit connected to the cage, a plurality of receptacle terminals and a plurality of receptacle power terminals. The housing comprises a base block extending transversely and a first tongue plate and a second tongue plate forwardly extending transversely from a front side face of the base block, the first tongue plate and the second tongue plate are arranged transversely at an interval. The cage surrounds the first tongue plate and the second tongue plate to define a mating space. The separation unit is positioned in the mating space and separates the mating space into an HDMI receptacle portion and a power receptacle portion respectively arranged transversely, the first tongue plate is positioned in the HDMI receptacle portion, the second tongue plate is positioned in the power receptacle portion. The plurality of receptacle terminals are for transmitting a signal conforming to HDMI transmission specification, and each receptacle terminals comprises a contact portion provided to the first tongue plate; the plurality of receptacle power terminals are for transmitting power, and each receptacle power terminals comprises a contact portion provided to the second tongue plate.

The plug connector comprises a plug housing, a terminal module provided to the plug housing and a plug cage installed to the plug housing. The plug housing comprises a base portion extending transversely, a plug structure forwardly extending transversely from a front side face of the base portion, and a separation portion. The plug structure is provided with an HDMI plug portion and a power plug portion respectively arranged transversely at an interval. The separation portion is positioned between the HDMI plug portion and the power plug portion to separate the HDMI plug portion and the power plug portion. The HDMI plug portion defines an HDMI slot therein and is capable of matching and inserting into HDMI slot; the power plug portion defines a power slot therein and is capable of matching and inserting into the power slot. The terminal module has a plurality of plug terminals and a plurality of plug power terminals, the plurality of plug terminals each have a contact portion positioned in the HDMI slot and can be electrically connected with the plurality of receptacle terminals to transmit a signal conforming to HDMI transmission specification. The plurality of plug power terminals each have a contact portion received in the power slot and can be electrically connected with the plurality of receptacle power terminals for transmitting power. The plug cage comprises a shielding sheath surrounding and covering the plug structure. The HDMI plug can be inserted into the HDMI receptacle portion of the receptacle connector.

DESCRIPTION OF THE PREFERRED EMBODIMENTS

The foregoing and other technical contents, features and effects of the present application will be apparent through the following detailed description for an embodiment in combination with the drawings.

Therefore, an object of the present application is to provide a receptacle connector, a plug connector and an electrical connector assembly which can provide an additional power supply without increasing an overall height. The present application has the following effects: by that the HDMI receptacle portion and the power receptacle portion in the receptacle connector are arranged transversely relative to each other, and the HDMI plug portion and the power plug portion in the plug connector are arranged transversely relative to each other, the electrical connector assembly is provided with an additional power supply without increasing an overall height of the electrical connector assembly. In addition, by that a slot of the HDMI receptacle portion corresponds to the standard HDMI plug in shape, the receptacle connector can mate a traditional HDMI plug besides the plug connector, so that the object of the present application is reliably achieved.

Figure 11:
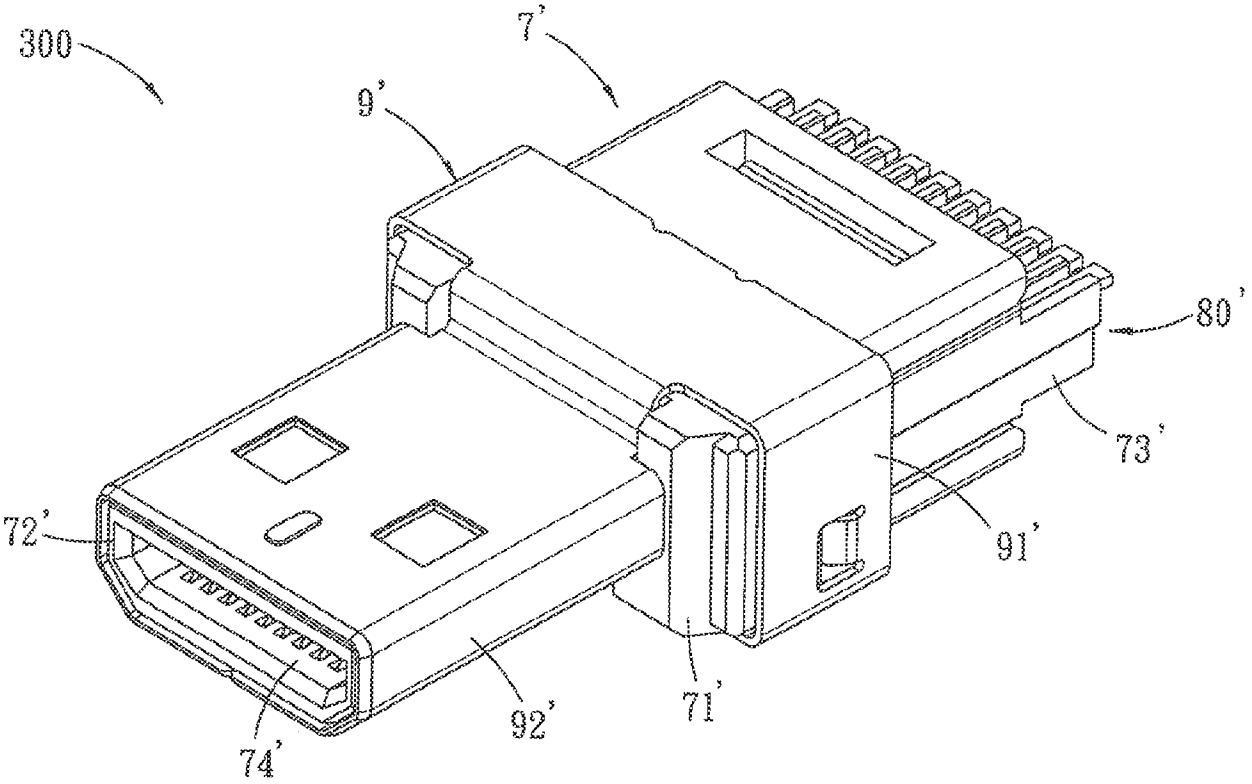
FIG. 11 is a perspective view illustrating an HDMI plug of the embodiment.
Figure 12:
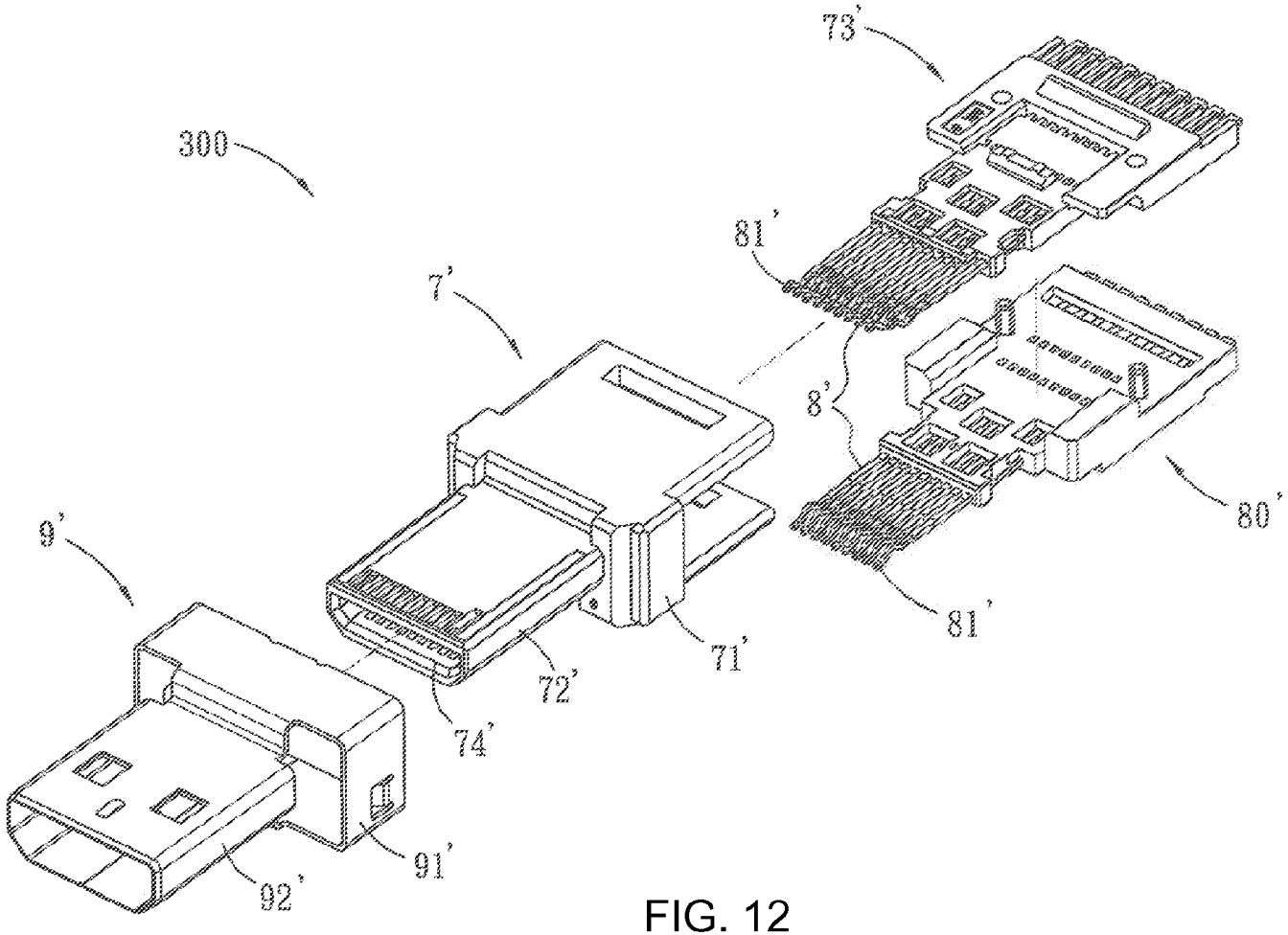
FIG. 12 is an exploded view illustrating elements of the HDMI plug of the embodiment.
Figure 13:
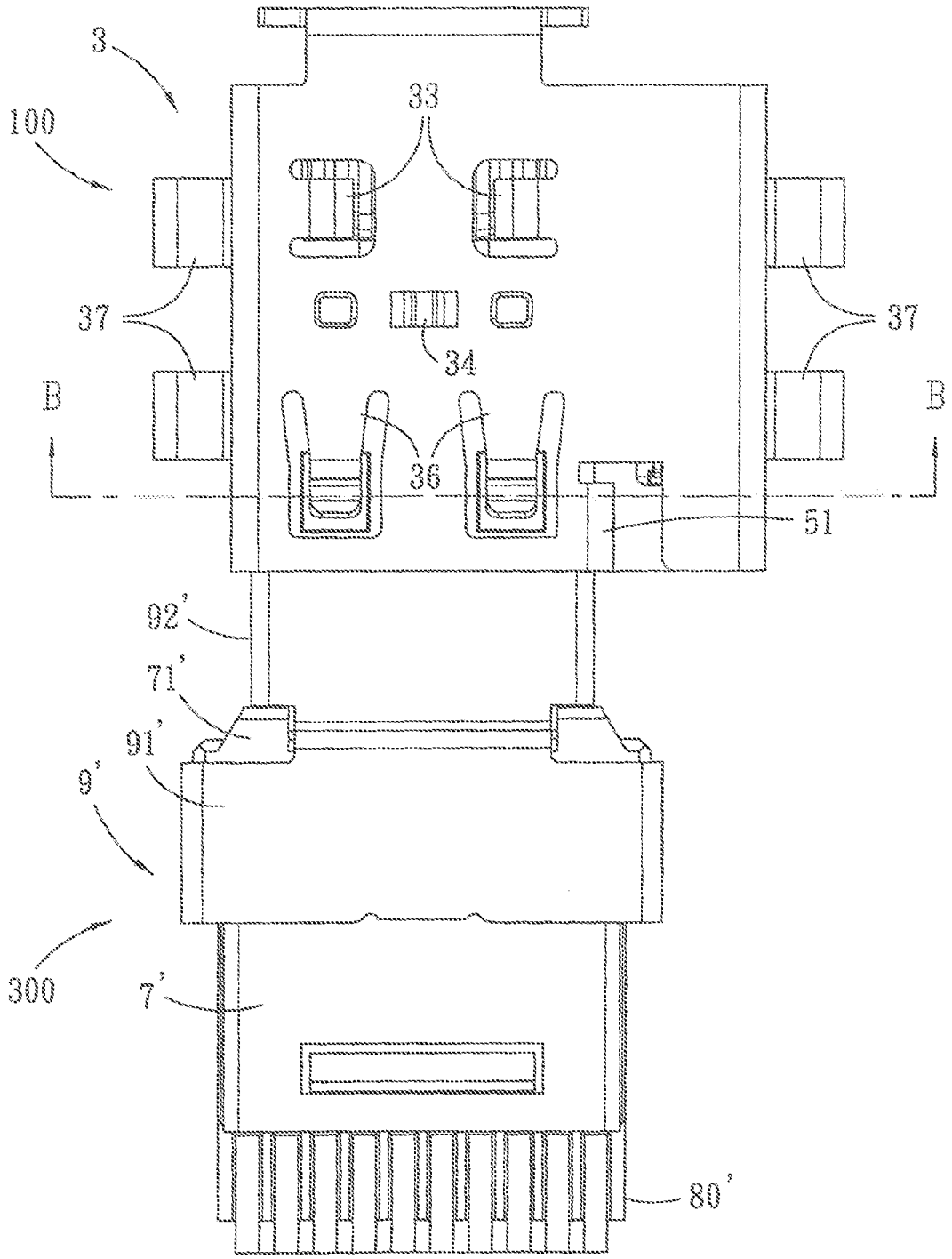
FIG. 13 is a top view illustrating mating of the HDMI plug and the receptacle connector of the embodiment.
Figure 14:
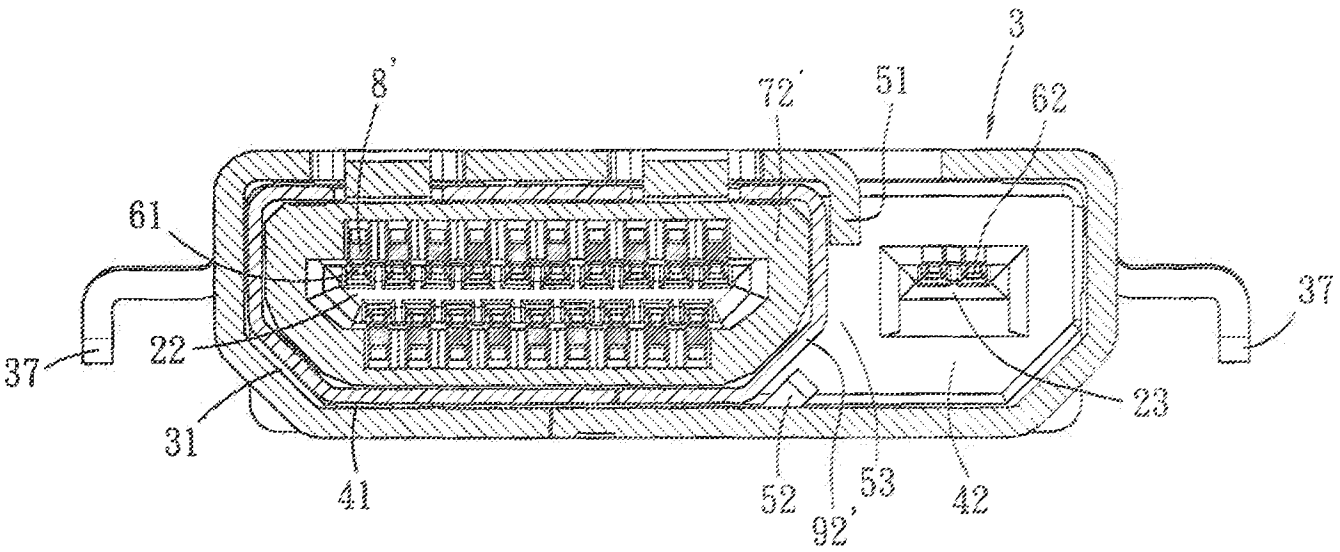
FIG. 14 is a cross-sectional view taken along a line B-B of FIG. 13 illustrating an internal structure when the HDMI plug and the receptacle connector are mated of the embodiment.

An embodiment of the electrical connector assembly of the present application comprises a receptacle connector 100 (referring to FIG. 3), a plug connector 200 (referring to FIG. 6) which can be selectively inserted into the receptacle connector 100, and an HDMI plug 300 (referring to FIG. 11) which can be selectively inserted into the receptacle connector 100. High Definition Multimedia Interface is hereinafter referred to as HDMI.

Figure 1:
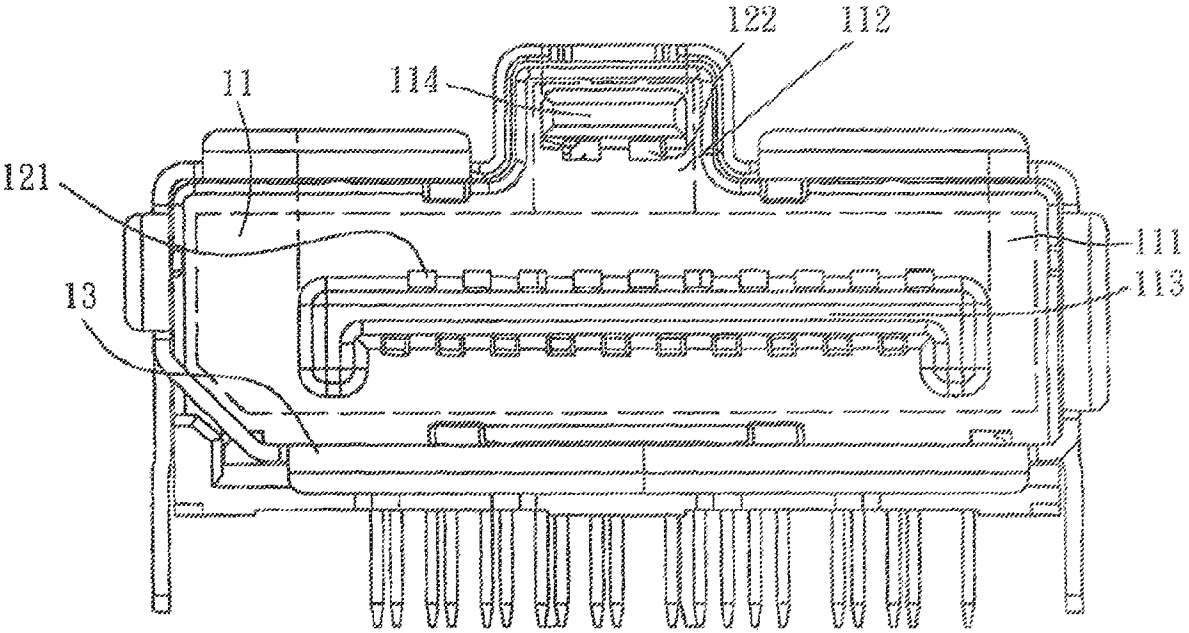
FIG. 1 PRIOR ART
FIG. 1 is a side view illustrating a receptacle connector in the prior art.
Figure 2:
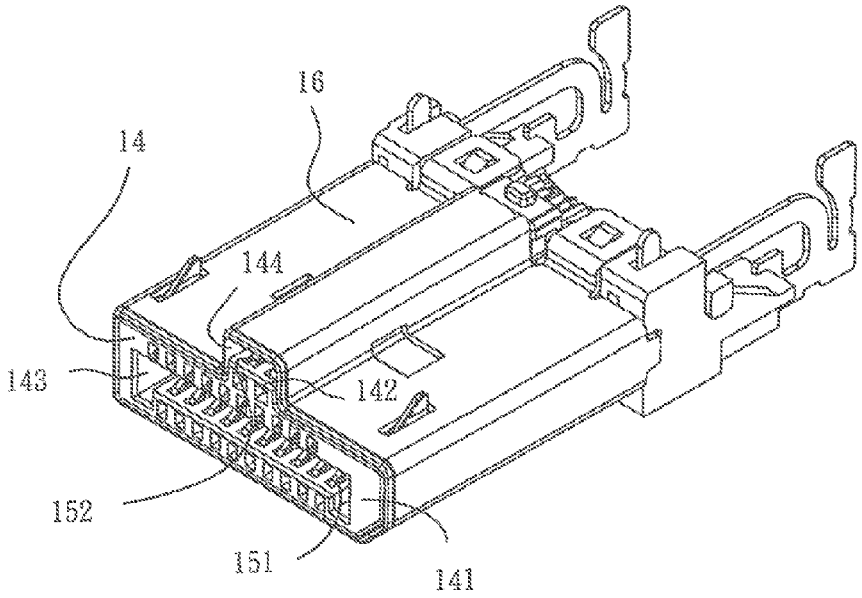
FIG. 2 PRIOR ART
FIG. 2 is a perspective view illustrating a plug connector in the prior art.
Figure 3:
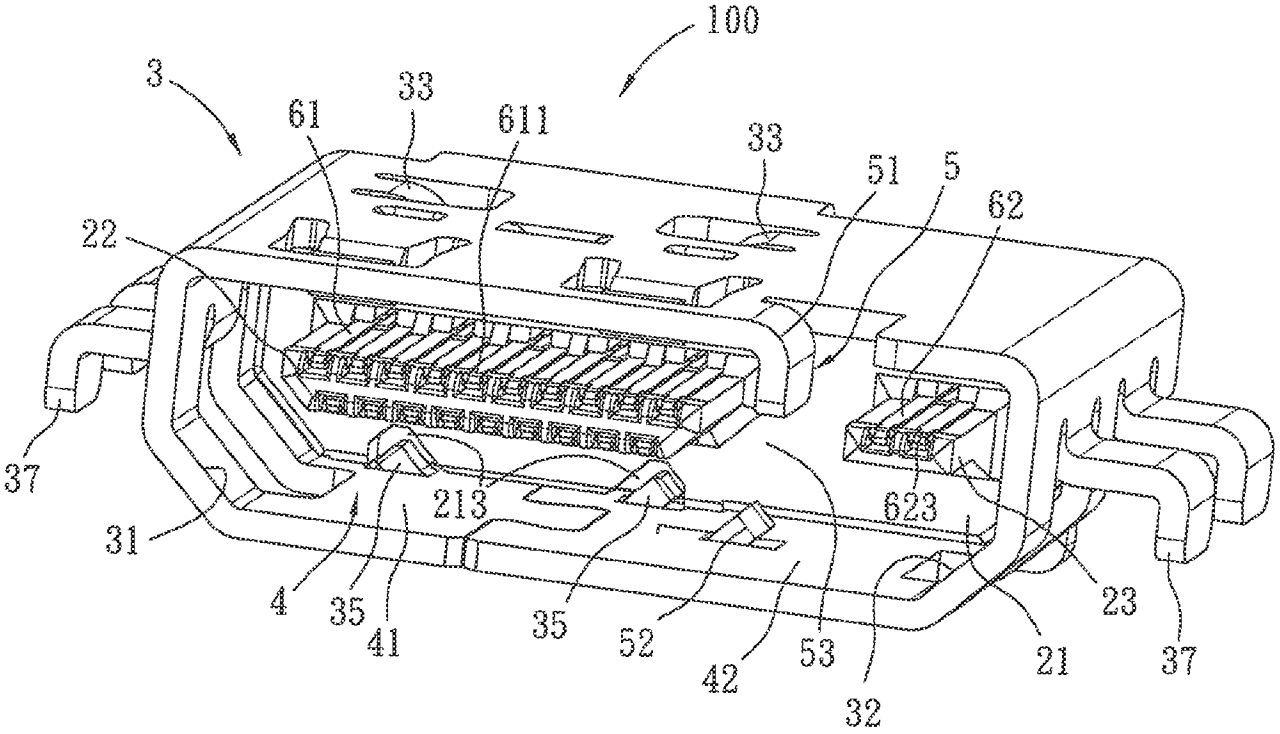
FIG. 3 is a perspective view illustrating a receptacle connector of an embodiment of an electrical connector assembly of the present application.
Figure 4:
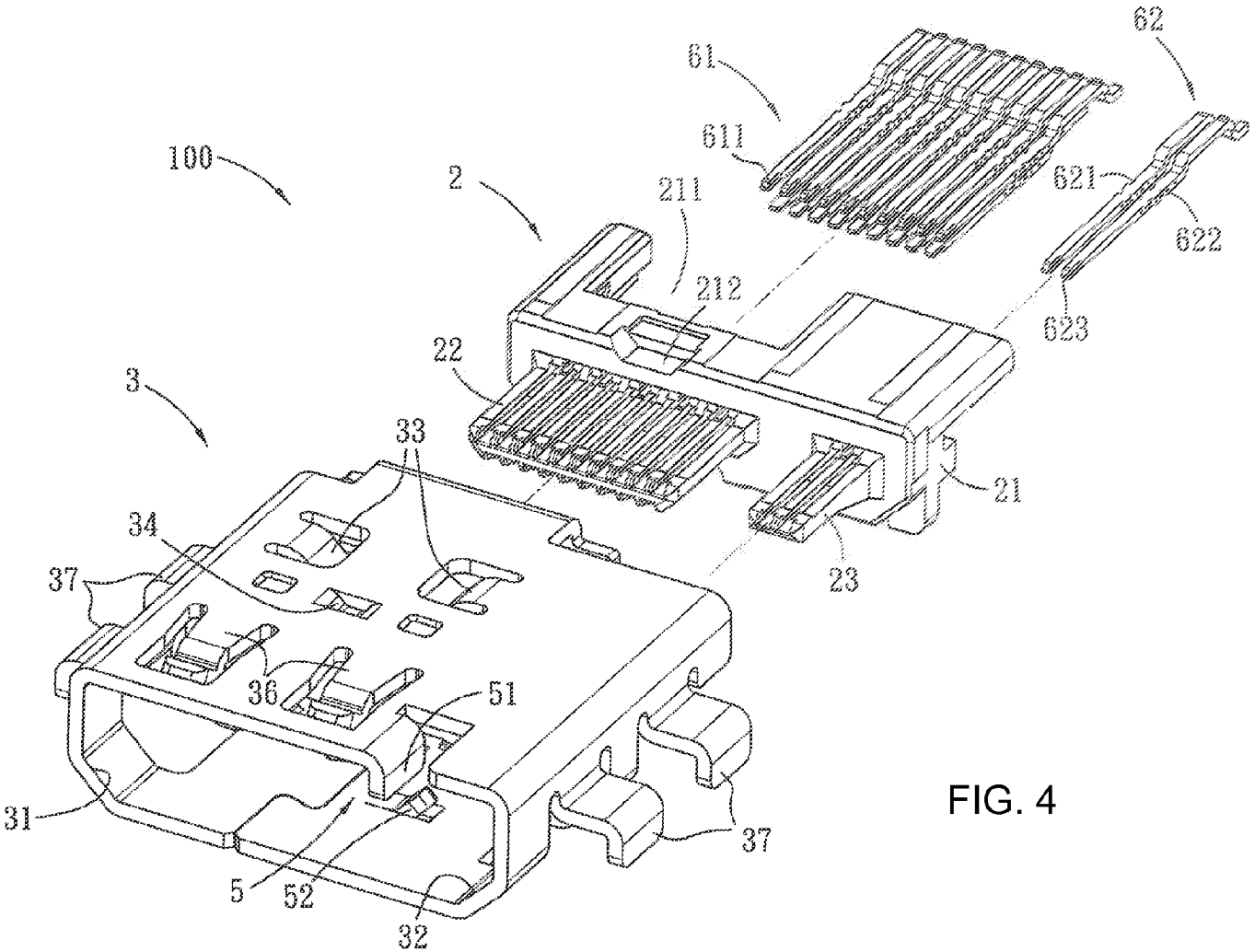
FIG. 4 is an exploded view illustrating elements of the receptacle connector of the embodiment.
Figure 5:
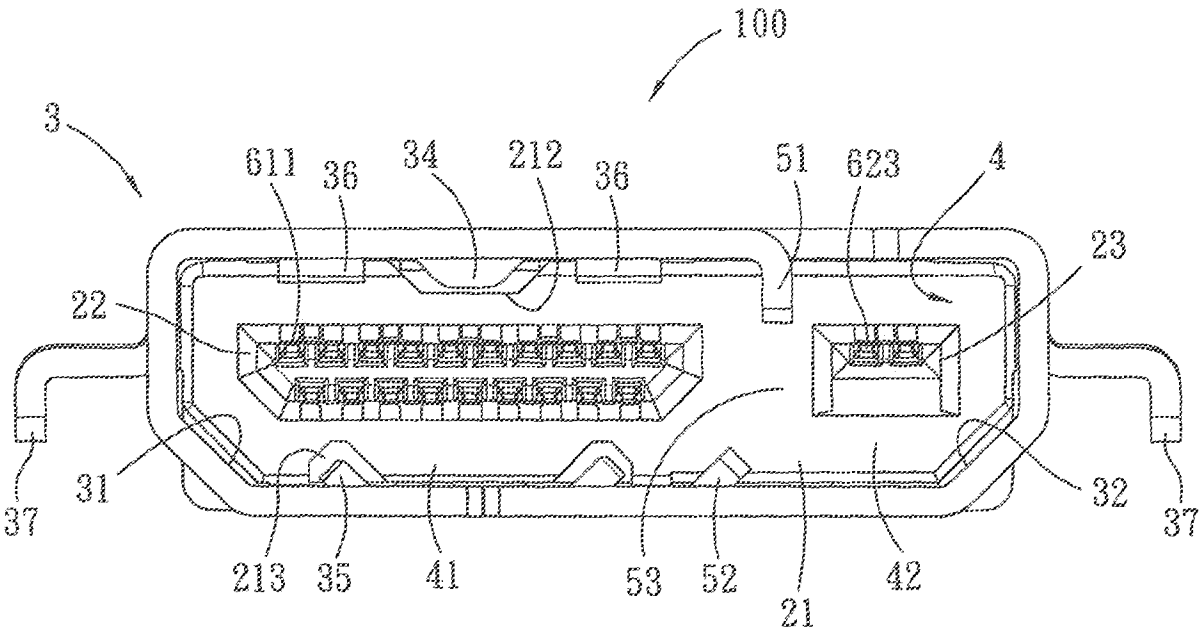
FIG. 5 is a side view illustrating a mating space of the receptacle connector of the embodiment.

Referring to FIG. 3, FIG. 4 and FIG. 5, a receptacle connector 100 in one embodiment is illustrated. The receptacle connector 100 comprises a housing 2, formed of an insulative material, a cage 3 provided to the housing 2, a separation unit 5 connected to the cage 3, a plurality of receptacle terminals 61, and a plurality of receptacle power terminals 62. The housing 2 comprises a base block 21, which can be rectangular, extending transversely, and a first tongue plate 22 and a second tongue plate 23 forwardly extending transversely from a front side face of the base block 21. The first tongue plate 22 and the second tongue plate 23 are respectively arranged transversely at an interval. The cage 3 surrounds the first tongue plate 22 and the second tongue plate 23 to define a mating space 4.

The separation unit 5 is positioned in the mating space 4 to separate the mating space 4 into an HDMI receptacle portion 41 and a power receptacle portion 42 which are respectively arranged transversely, and comprises a first separation plate 51 and a second separation plate 52 respectively extending from two opposite faces of the cage 3 toward the mating space 4, and a communication space 53 positioned between the first separation plate 51 and the second separation plate 52 to communicate the HDMI receptacle portion 41 and the power receptacle portion 42. In one embodiment, the first separation plate 51 extends from a top wall of the cage 3 toward the mating space 4, the second separation plate 52 extends from a bottom wall of the cage 3 relative to the first separation plate 51 toward the mating space 4. The first tongue plate 22 is positioned in the HDMI receptacle portion 41, and the second tongue plate 23 is positioned in the power receptacle portion 42. A contact portion 611 of each receptacle terminals 61 is provided to the first tongue plate 22 for transmitting a signal conforming to a HDMI transmission specification. A contact portion 623 of each receptacle power terminals 62 is provided to the second tongue plate 23 for transmitting power. Wherein, in one embodiment the plurality of receptacle power terminals 62 comprise a positive terminal 621 and a negative terminal 622, other terminals can be additionally provided in a varied embodiment for power supplies with different voltage combinations.

The base block 21 is further provided with a recessed portion 211 positioned in a rear side, a first fixing groove 212 positioned in a front side of the top of the base block 21, and two second fixing grooves 213 positioned in a front side of the bottom of the base block 21. The cage 3 further comprises a plurality of bent hooks 33 extending into the recessed portion 211 and tightly latching both sides of a rear end of the base block 21, a fixing portion 34 inwardly protruding to extend into the first fixing groove 212, and two fixing pieces 35 oppositely protruding inwardly from the cage 3 to extend into the second fixing grooves 213. By that the fixing portion 34 and the fixing pieces 35 both tightly abut the front side of the base block 21, and the plurality of bent hooks 33 tightly latch the rear side of the base block 21, the cage 3 is constrained relative to the base block 21 in the front-back direction. The top wall of the cage 3 is provided with two leaf springs 36, and two side faces of the cage 3 have a plurality of retaining leg portions 37 for being fixed or soldered to a circuit board (not shown).

Figure 6:
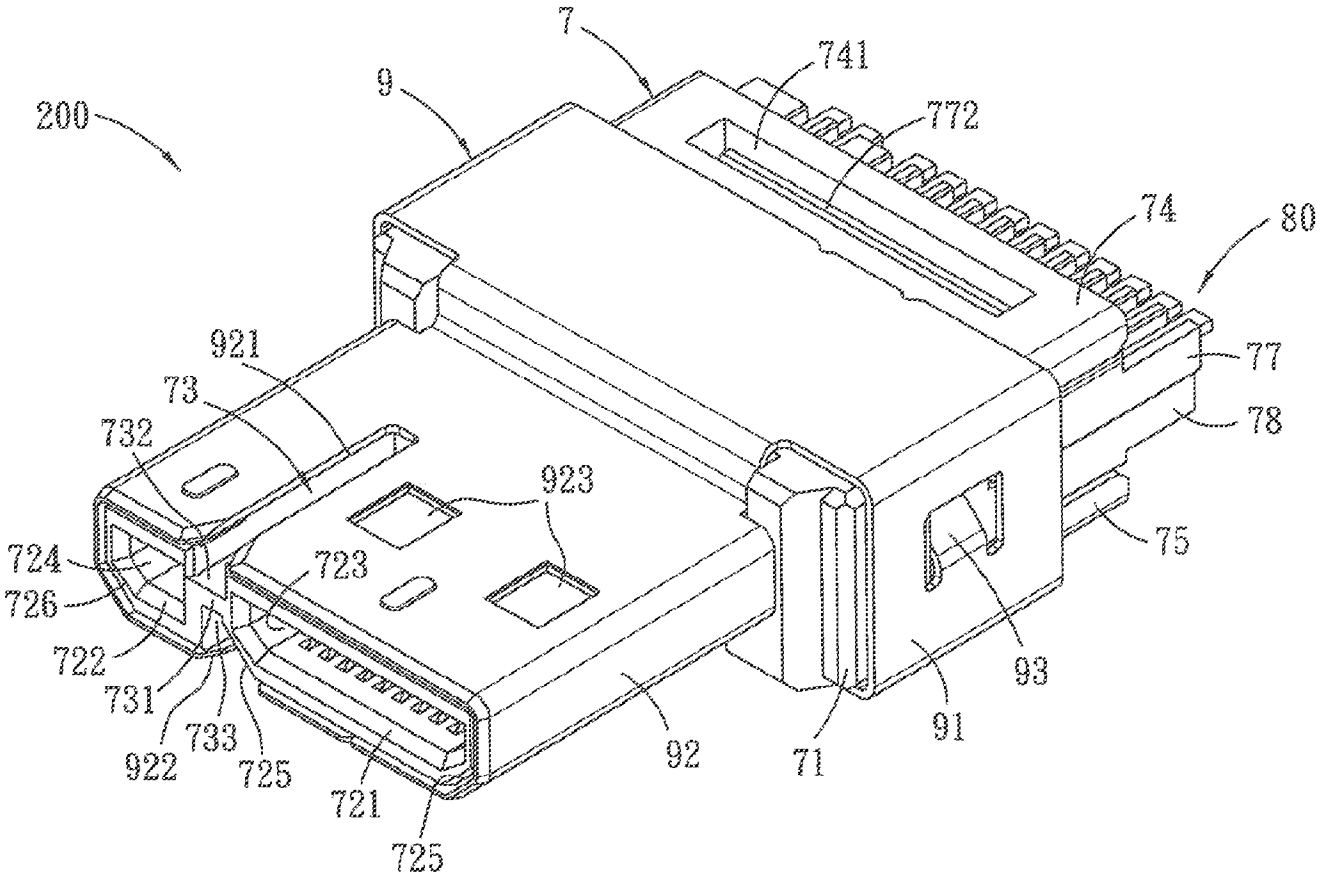
FIG. 6 is a perspective view illustrating a plug connector of the embodiment.
Figure 7:
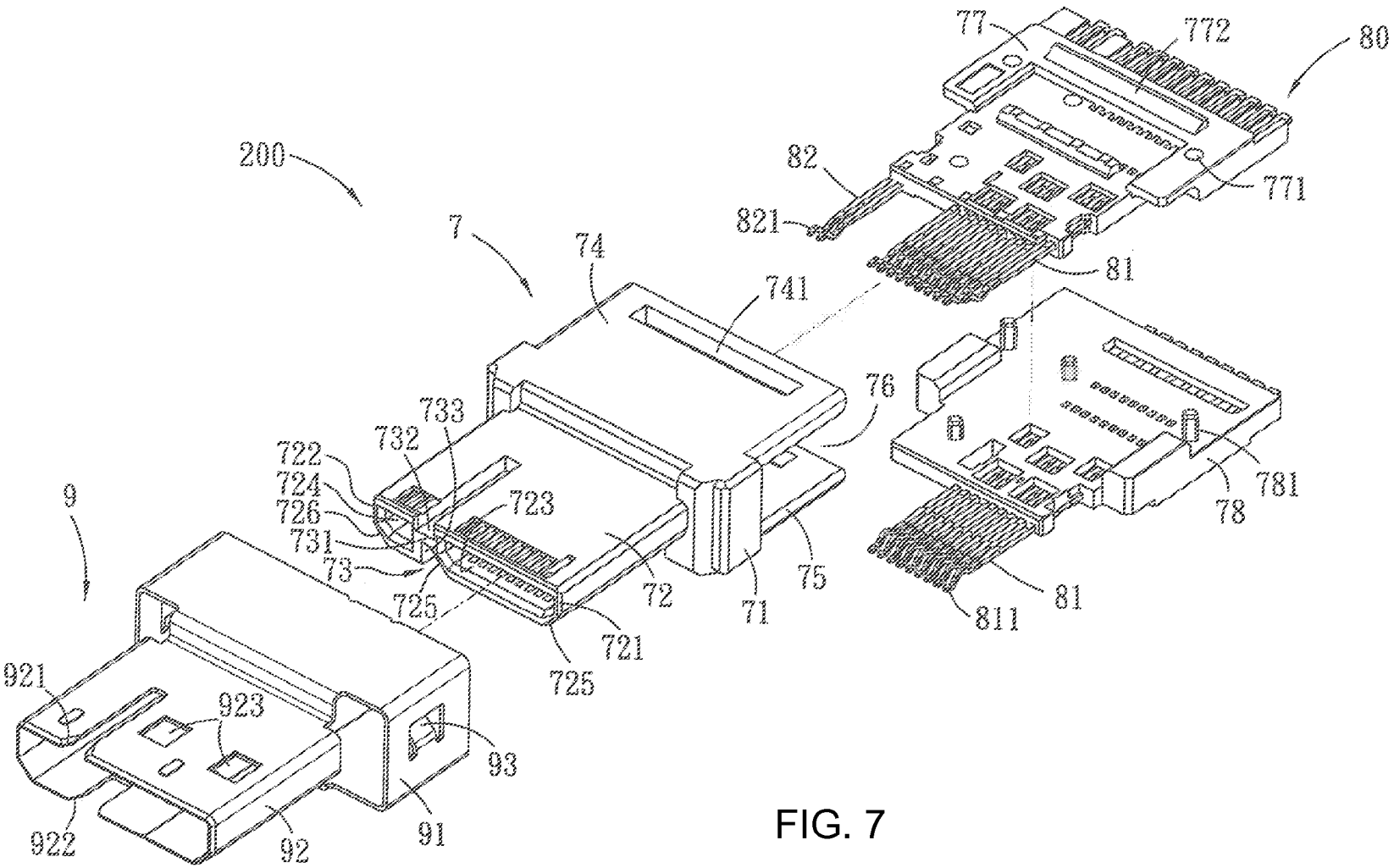
FIG. 7 is an exploded view illustrating elements of the plug connector of the embodiment.
Figure 8:
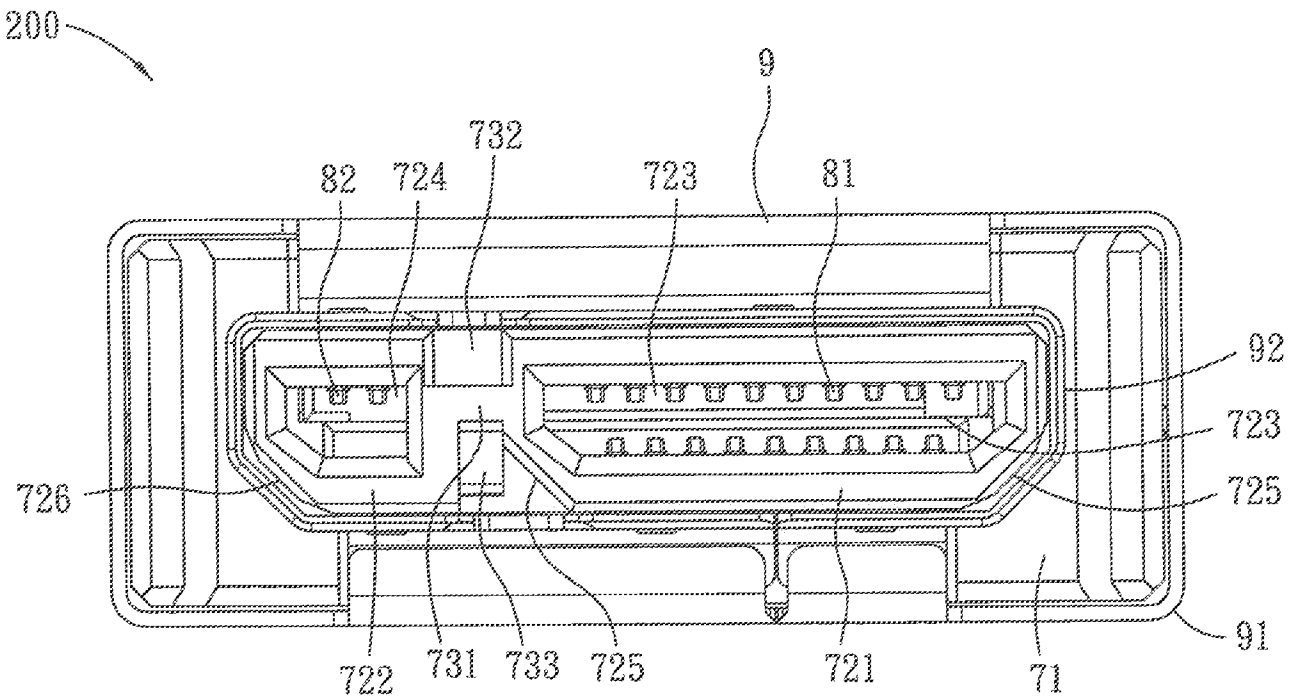
FIG. 8 is a side view illustrating a plug structure of the plug connector of the embodiment.
Figure 9:
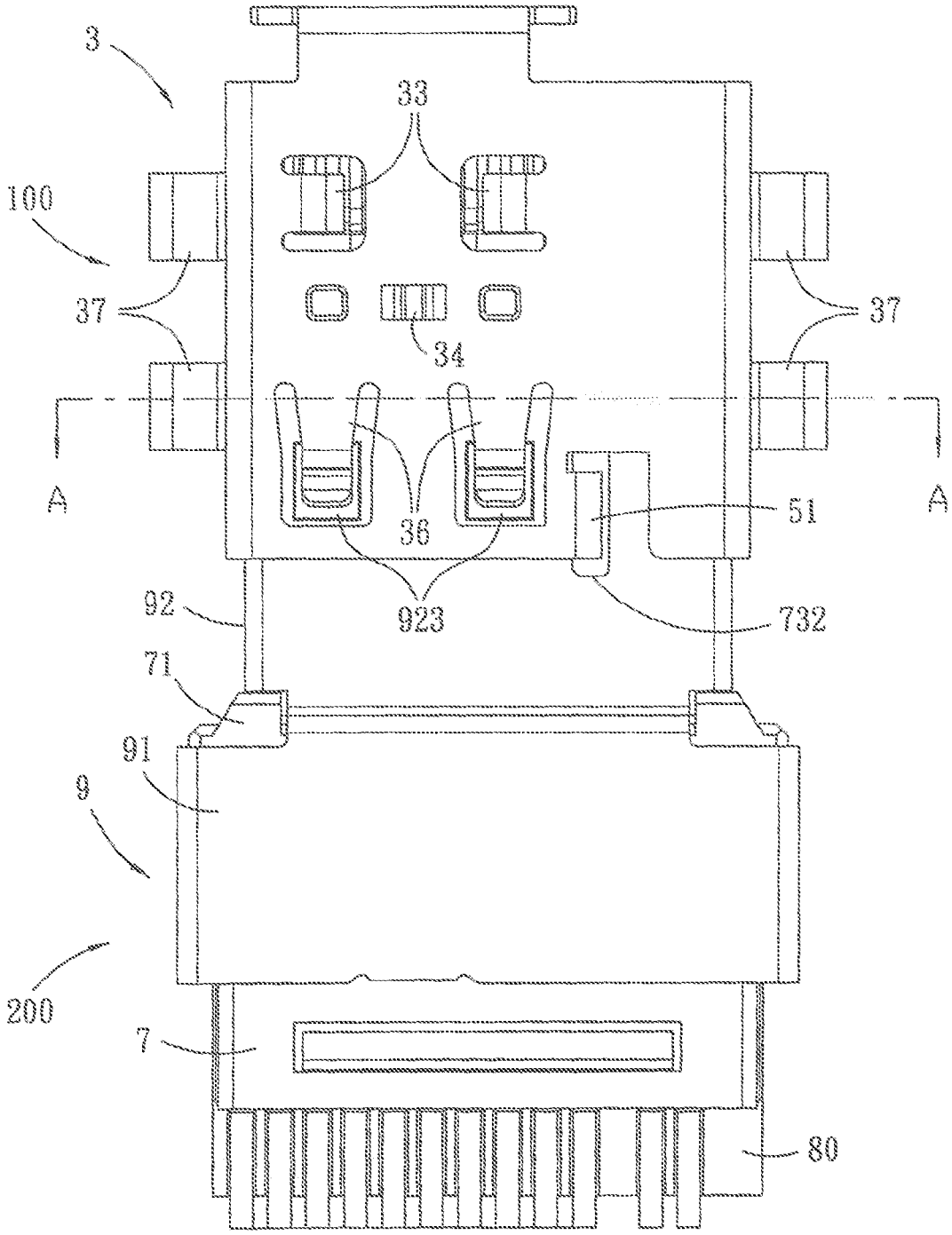
FIG. 9 is a top view illustrating mating of the plug connector and the receptacle connector of the embodiment.
Figure 10:
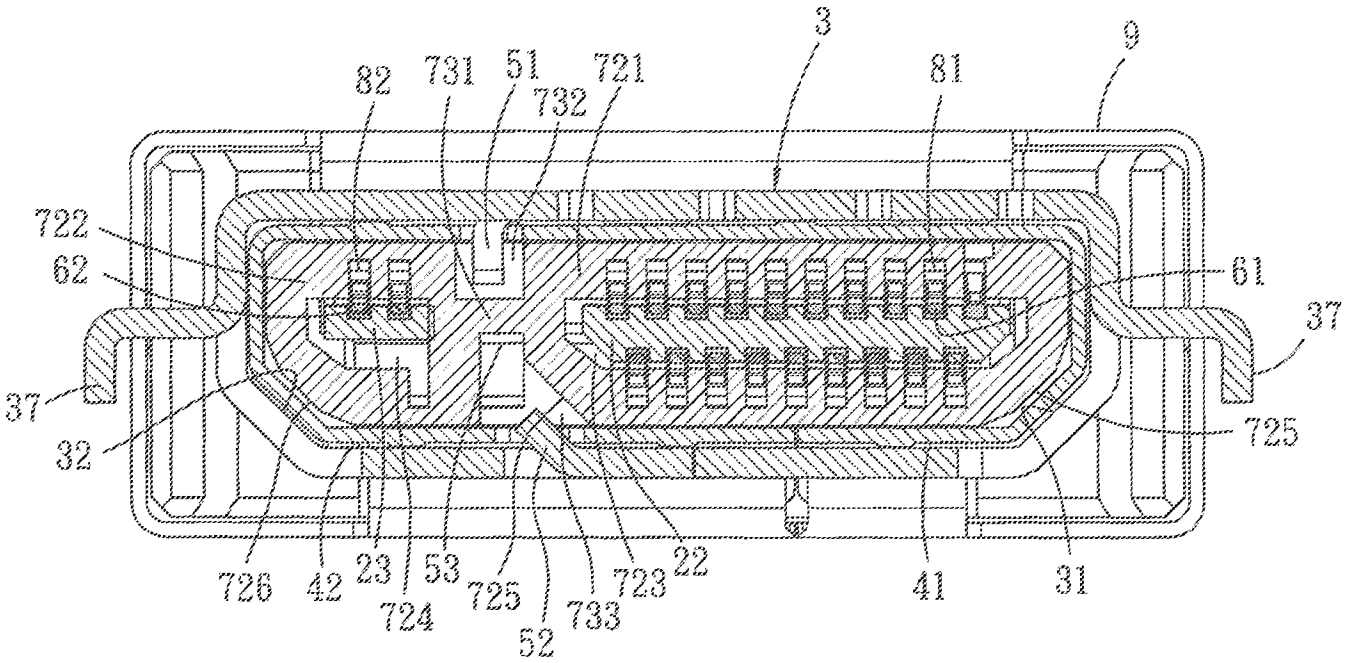
FIG. 10 is a cross-sectional view taken along a line A-A of FIG. 9 illustrating an internal structure when the plug connector and the receptacle connector are mated of the embodiment.

Referring to FIG. 6, FIG. 7 and FIG. 8, an embodiment of a plug connector 200 is illustrated. The plug connector 200 comprises a plug housing 7, a terminal module 80 provided to the plug housing 7, and a plug cage 9 installed to the plug housing 7. The plug housing 7 comprises a base portion 71, which can be rectangular, extending transversely, a plug structure 72 forwardly extending transversely from a front side face of the base portion 71, and a separation portion 73. An end of the plug structure 72 is provided with an HDMI plug portion 721 and a power plug portion 722 respectively arranged transversely at an interval. The separation portion 73 is positioned between the HDMI plug portion 721 and the power plug portion 722 to separate the HDMI plug portion 721 and the power plug portion 722. The HDMI plug portion 721 and the power plug portion 722 respectively define an HDMI slot 723 and a power slot 724 therein.

The terminal module 80 comprises a plurality of plug terminals 81 and a plurality of plug power terminals 82. The plurality of plug terminals 81 each have a contact portion 811 positioned in the HDMI slot 723, and the plurality of plug terminals 81 can be electrically connected to the plurality of receptacle terminals 61 (see FIG. 5) so as to transmit the signal conforming to the HDMI transmission specification. The plurality of plug power terminals 82 each have a contact portion 821 received in the power slot 724, and the plurality of plug power terminals 82 can be electrically connected to the plurality of receptacle power terminals 62 (see FIG. 5) so as to transmit power. The plug cage 9 comprises a collar 91 fixed to the base portion 71, a shielding sheath 92 extending forwardly from the collar 91 and surrounding and covering the plug structure 72, and two fixed hooks 93 oppositely extending inwardly from two opposite sides of the collar 91. The plurality of fixed hooks 93 match with each other to clamp the base portion 71, so as to allow the plug cage 9 and the base portion 71 to be firmly fixed to each other.

The separation portion 73 has a connection plate 731 transversely connecting the HDMI plug portion 721 and the power plug portion 722, a first recessed groove 732 positioned in one side of the connection plate 731, and a second recessed groove 733 positioned in the other side of the connection plate 731. Further in combination with referring to FIG. 5, a shape of the connection plate 731 matches with the communication space 53 so as to be received in the communication space 53. The first recessed groove 732 can receive the first separation plate 51, and the second recessed groove 733 can receive the second separation plate 52. The shielding sheath 92 of the plug cage 9 are provided with a first cutout 921 having a shape matching with the first recessed groove 732 to allow the first separation plate 51 to pass through and a second cutout 922 having a shape matching with the second recessed groove 733 to allow the second separation plate 52 to pass through, respectively, at positions corresponding to the first recessed groove 732 and the second recessed groove 733, a top face of the shielding sheath 92 has two concave portions 923 which can be latched by the two leaf springs 36 in the top wall of the cage 3 of the receptacle connector 100.

The plug housing 7 further has an assembling space 76 communicating the HDMI slot 723 and the power slot 724, and an upper clamping plate 74 and a lower clamping plate 75 which extend rearwardly from a rear side of the base portion 71. The terminal module 80 further comprises a first frame 77 and a second frame 78 which are secured to each other. A surface of the first frame 77 is provided with a plurality of first latch portions 771. The second frame 78 is provided with a plurality of second latch portions 781 at positions corresponding to the plurality of first latch portions 771 so as to be engaged with the plurality of first latch portions 771. In one embodiment, the first latch portion 771 and the second latch portion 781 are respectively a through hole and a post, but configurations of the first latch portion 771 and the second latch portion 781 are not limited to that, as long as the first frame 77 and the second frame 78 can be fixed to each other. The plurality of plug terminals 81 are divided into two groups which are embedded and fixed respectively in the first frame 77 and the second frame 78. The plurality of plug power terminals 82 are partially embedded and fixed in the first frame 77 and spaced from the plurality of plug terminals 81. The first frame 77 and the second frame 78 latch with each other and then are inserted into the assembling space 76 in the plug housing 7, and are fixed to the plug housing 7 by that protruding blocks 772 respectively formed in the first frame 77 and the second frame 78 and catching grooves 741 respectively formed in the upper clamping plate 74 and the lower clamping plate 75 latch with each other.

Referring to FIG. 3, FIG. 6, FIG. 9 and FIG. 10, when the receptacle connector 100 and the plug connector 200 are mated, the plug structure 72 of the plug connector 200 together with the shielding sheath 92 covering the plug structure 72 are inserted into the mating space 4 of the receptacle connector 100, so that the HDMI plug portion 721 and the power plug portion 722 of the plug structure 72 are received in the HDMI receptacle portion 41 and the power receptacle portion 42 of the mating space 4, respectively, and the connection plate 731 of the plug connector 200 is received in the communication space 53 of the receptacle connector 100. At this time, the first tongue plate 22 is inserted into the HDMI slot 723 so as to electrically connect the plurality of plug terminals 81 and the plurality of receptacle terminals 61 and transmit a signal conforming to the HDMI transmission specification. In the meantime, the second tongue plate 2 is inserted into the power slot 724 so as to electrically connect the plurality of plug power terminals 82 and the plurality of receptacle power terminals 62 and transmit power.

In addition, the cage 3 of the receptacle connector 100 is provided with an HDMI receptacle oblique corner 31 and a power receptacle oblique corner 32 at corners defining the HDMI receptacle portion 41 and the power receptacle portion 42, respectively, and the second separation plate 52 of the receptacle connector 100 extends obliquely from the cage 3 at an angle symmetrically to an angle of the HDMI receptacle oblique corner 31, and the first separation plate 51 of the receptacle connector 100 extends vertically from an inner face of the cage 3. Moreover, a corner of the HDMI plug portion 721 adjacent to the second recessed groove 733 and a corner thereof far away from the second recessed groove 733 are respectively provided with oblique corners 725, the plurality of oblique corners 725 are symmetrical to each other. And a corner of the power plug portion 722 far away from the second recessed groove 733 is provided with an oblique corner 726. The oblique angles of the oblique corner 31 and the second separation plate 52 described above and the oblique angles of the oblique corners 725 correspond to each other, while the oblique angle of the oblique corner 32 and the oblique angle of the oblique corner 726 correspond to each other. By such a design that the oblique angles correspond to each other, incorrect insertion in a wrong direction can be prevented when a user inserts the plug structure 72 into the mating space 4, and a smooth guiding is provided for the plug structure 72 while inserting and the receptacle connector 100 and the plug connector 200 are further secured once the plug structure 72 is inserted.

Referring to FIGS. 11-14, a HDMI plug 300 of one embodiment is illustrated, the HDMI plug 300 is a plug conforming to the HDMI specification, and is for being inserted into the HDMI receptacle portion 41 of the receptacle connector 100. The HDMI plug 300 comprises an plug housing 7', a terminal module 80' assembled into the plug housing 7' of the HDMI plug 300, and a cage 9' installed to the plug housing 7' of the HDMI plug 300. The plug housing 7' of the HDMI plug 300 comprises a base portion 71' extending transversely, and an HDMI plug portion 72' outwardly extends transversely from a side face of the base portion 71' of the HDMI plug 300. The HDMI plug portion 72' of the HDMI plug 300 can be inserted into the HDMI receptacle portion 41 (see FIG. 5) via a matched shape thereof, and defines a terminal slot 74' therein. The terminal module 80' of the HDMI plug 300 comprises a plurality of terminals 8' each of which extends into the terminal slot 74' at one end, the plurality of terminals 8' can be electrically connected with the plurality of receptacle terminals 61 so as to transmit the signal conforming to the HDMI transmission specification. The cage 9' of the HDMI plug 300 comprises a collar 91' fixed to the base portion 71' of the HDMI plug 300, and a shielding sheath 92' extending forwardly from the collar 91' of the HDMI plug 300 and surrounding the HDMI plug portion 72' of the HDMI plug 300. The shielding sheath 92' of the HDMI plug 300 covers the HDMI plug portion 72' of the HDMI plug 300, so as to provide an additional protection for the HDMI plug portion 72' of the HDMI plug 300.

When the receptacle connector 100 and the HDMI plug 300 are mated, the HDMI plug portion 72' of the HDMI plug 300 together with the shielding sheath 92' covering the plug structure 72' are inserted into the HDMI receptacle portion 41 of the receptacle connector 100 so as to electrically connect the plurality of terminals 8' and the plurality of receptacle terminals 61 and transmit the signal conforming to the HDMI transmission specification. It should be noted that, two corners of the HDMI plug portion 72' of the HDMI plug 300 are formed as two oblique corners symmetrical to each other. The oblique angles of the oblique corners as described above corresponds to the oblique angles of the HDMI receptacle oblique corner 31 and the second separation plate 52. By that incorrect insertion in a wrong direction is prevented when the user mates the HDMI plug 300 and the receptacle connector 100, and in the meantime a smooth guiding is provided for the HDMI plug portion 72' of the HDMI plug 300, and the fixed effect of the receptacle connector 100 and the HDMI plug 300 is improved after the HDMI plug portion 72' of the HDMI plug 300 is inserted.

In conclusion, the receptacle connector 100 divides the mating space 4 into the HDMI receptacle portion 41 and the power receptacle portion 42 which are respectively arranged transversely via the separation unit 5, so as to provide additional power supply for the receptacle connector 100 without increasing the overall height, and meet the requirement to be mounted in thin-type electronic equipment. And the separation portion 73 of the plug connector 200 divides the plug structure 72 into the HDMI plug portion 721 and the power plug portion 722, so as to provide additional power supply for the plug connector 200 without increasing the overall height. In addition, by that the oblique angles of the HDMI receptacle oblique corner 31 and the second separation plate 52 correspond to the HDMI plug oblique corners 725, incorrect insertion in a wrong direction can be prevented and a smooth guiding is provided when the user inserts the plug structure 72 into the mating space 4. Furthermore, the HDMI receptacle portion 41 of the receptacle connector 100 allows the standard HDMI plug 300 to be inserted via the matched shape, the receptacle connector 100 can be connected to the traditional HDMI plug 300 besides the plug connector 200, so that the object of the present application can be reliably achieved.

However, as described above is only embodiments of the present application, the implementation scope of the present application is not limited to that, that is, simple equivalent variations and modifications which are made according to the Claims and the description content of the present application are included in the protective scope of the present application.

What is claimed is:

1. A receptacle connector, comprising:

an housing comprising a base block extending transversely and a first tongue plate and a second tongue plate extending forward from a front side face of the base block, the first tongue plate and the second tongue plate being arranged transversely at an interval;

a cage installed to the housing and surrounding the first tongue plate and the second tongue plate to define a mating space;

a separation unit connected to the cage and positioned in the mating space and separating the mating space into an HDMI receptacle portion and a power receptacle portion respectively arranged transversely, the first tongue plate being positioned in the HDMI receptacle portion, the second tongue plate being positioned in the power receptacle portion;

a plurality of receptacle terminals for transmitting a signal conforming to HDMI transmission specification, and each receptacle terminals comprising a contact portion provided to the first tongue plate; and a plurality of receptacle power terminals for transmitting power, each receptacle power terminals comprising a contact portion provided to the second tongue plate.

2. The receptacle connector according to claim 1, wherein the separation unit comprises a first separation plate and a second separation plate extending respectively from two opposite faces of the cage toward the mating space, and a communication space positioned between the first separation plate and second separation plate so as to allow communication between the HDMI receptacle portion and the power receptacle portion.

3. The receptacle connector according to claim 2, wherein a corner of the cage defining the HDMI receptacle portion is provided with an oblique corner; the second separation plate extends obliquely from the cage at an angle symmetrically to an angle of the oblique corner and the first separation plate extends vertically from an inner face of the cage.

4. The receptacle connector according to claim 3, wherein a corner of the cage defining the power receptacle portion is provided with an oblique corner.

5. The receptacle connector according to claim 2, wherein the plurality of receptacle power terminals comprise a positive terminal and a negative terminal.

6. A plug connector, comprising:

an plug housing comprising a base portion extending transversely, a plug structure forwardly extending transversely from a front side face of the base portion, and a separation portion, the plug structure being provided with an HDMI plug portion and a power plug portion respectively arranged transversely at an interval, the separation portion being positioned between the HDMI plug portion and the power plug portion to separate the HDMI plug portion and the power plug portion, the HDMI plug portion defining an HDMI slot therein, the power plug portion defining a power slot therein;

a terminal module provided to the plug housing, and comprising a plurality of plug terminals and a plurality of plug power terminals, the plurality of plug terminals each having a contact portion positioned in the HDMI slot and being for transmitting a signal conforming to HDMI transmission specification, the plurality of plug power terminals each having a contact portion received in the power slot and being for transmitting power; and a plug cage installed to the plug housing, the plug care including a shielding sheath surrounding and covering the plug structure.

7. The plug connector according to claim 6, wherein the separation portion has a connection plate connecting the HDMI plug portion and the power plug portion, a first recessed groove positioned in one side of the connection plate, and a second recessed groove positioned in the other side of the connection plate.

8. The plug connector according to claim 7, wherein a corner of the HDMI plug portion adjacent to the second recessed groove and a corner spaced from the second recessed groove are respectively provided with oblique corners and the oblique corners are symmetrical to each other.

9. The plug connector according to claim 8, wherein a corner of the power plug portion far away from the second recessed groove is provided with an oblique corner.

10. The plug connector according to claim 6, wherein the plug housing further has an assembling space communicating the HDMI slot and the power slot; the terminal module further comprises a first frame and a second frame; the first frame is provided with a plurality of first latch portions; the second frame is provided with a plurality of second latch portions fixed by latching the plurality of first latch portions; the first frame and the second frame are positioned in the assembling space, the first frame and the second frame and the plug housing are fixed to each other; the plurality of plug terminals are divided into two groups which are embedded and fixed respectively to the first frame and the second frame; the plurality of plug power terminals are partially embedded in the first frame and spaced from the plurality of plug terminals.

11. The plug connector according to claim 7, wherein the shielding sheath of the plug cage is provided with a first cutout having a shape matching with the first recessed groove, and a second cutout having a shape matching with the second recessed groove, respectively, at positions corresponding to the first recessed groove and the second recessed groove.

12. An electrical connector assembly comprising:

a receptacle connector, the receptacle connector comprising:

an housing comprising a base block extending transversely and a first tongue plate and a second tongue plate forwardly extending transversely from a front side face of the base block, the first tongue plate and the second tongue plate being arranged transversely at an interval;

a cage installed to the housing and surrounding the first tongue plate and the second tongue plate to define a mating space;

a separation unit connected to the cage and positioned in the mating space and separating the mating space into an HDMI receptacle portion and a power receptacle portion respectively arranged transversely, the first tongue plate being positioned in the HDMI receptacle portion, the second tongue plate being positioned in the power receptacle portion;

a plurality of receptacle terminals for transmitting a signal conforming to HDMI transmission specification, and each receptacle terminals comprising a contact portion provided to the first tongue plate; and a plurality of receptacle power terminals for transmitting power, and each receptacle power terminals comprising a contact portion provided to the second tongue plate;

a plug connector, the plug connector comprising:

an plug housing comprising a base portion extending transversely, a plug structure forwardly extending transversely from a front side face of the base portion, and a separation portion, the plug structure being provided with an HDMI plug portion and a power plug portion respectively arranged transversely at an interval, the separation portion being positioned between the HDMI plug portion and the power plug portion to separate the HDMI plug portion and the power plug portion, the HDMI plug portion defining an HDMI slot therein, the power plug portion defining a power slot therein, the HDMI receptacle portion being capable of matching and inserting into HDMI slot, the power receptacle portion being capable of matching and inserting into the power slot;

a terminal module provided to the plug housing, and comprising a plurality of plug terminals and a plurality of plug power terminals, the plurality of plug terminals each having a contact portion positioned in the HDMI slot and being for transmitting a signal conforming to HDMI transmission specification, the plurality of plug power terminals each having a contact portion received in the power slot and being for transmitting power; and a plug cage installed to the plug housing and comprising a shielding sheath surrounding and covering the plug structure.

13. The electrical connector assembly according to claim 12, wherein the separation portion comprises a first separation plate and a second separation plate extending respectively from two opposite faces of the cage toward the mating space and a communication space positioned between the first separation plate and second separation plate and the separation portion has a connection plate connecting the HDMI plug portion and the power plug portion, a first recessed groove positioned in one side of the connection plate, and a second recessed groove positioned in the other side of the connection plate and the first recessed groove can receive the first separation plate of the receptacle connector; the second recessed groove can receive the second separation plate of the receptacle connector.

14. The electrical connector assembly according to claim 13, wherein a corner of the cage defining the HDMI receptacle portion is provided with an HDMI receptacle oblique corner; the second separation plate extends obliquely from the cage at an angle symmetrically to an angle of the HDMI receptacle oblique corner, the first separation plate extends vertically from an inner face of the cage and a corner of the HDMI plug portion adjacent to the second recessed groove and a corner thereof far away from the second recessed groove are respectively provided with oblique HDMI plug oblique corners, the HDMI plug oblique corners are symmetrical to each other and the oblique angles of the HDMI receptacle oblique corner and the second separation plate correspond to the HDMI plug oblique corners.

15. The electrical connector assembly according to claim 14, wherein a corner of the cage defining the power receptacle portion is provided with a power receptacle oblique corner and a corner of the power plug portion far away from the second recessed groove is provided with a power plug oblique corner and the oblique angle of the power plug oblique corner and the oblique angle of the power receptacle oblique corner correspond to each other.

16. The electrical connector assembly according to claim 12, wherein the plurality of receptacle power terminals comprise a positive terminal and a negative terminal.

17. The electrical connector assembly according to claim 12, wherein the plug housing further has an assembling space communicating the HDMI slot and the power slot; the terminal module further comprises a first frame and a second frame; the first frame is provided with a plurality of first latch portions; the second frame is provided with a plurality of second latch portions fixed by latching the plurality of first latch portions; the first frame and the second frame are positioned in the assembling space, the first frame and the second frame and the plug housing are fixed to each other; the plurality of plug terminals are divided into two groups which are embedded and fixed respectively to the first frame and the second frame; the plurality of plug power terminals are partially embedded in the first frame and spaced from the plurality of plug terminals.

18. The electrical connector assembly according to claim 12, wherein the shielding sheath of the plug cage are provided with a first cutout having a shape matching with the first recessed groove, and a second cutout having a shape matching with the second recessed groove, respectively, at positions corresponding to the first recessed groove and the second recessed groove.

* * * * *